United States Patent [19]
Dudro, Jr. et al.
[11] Patent Number: 4,478,395
[45] Date of Patent: Oct. 23, 1984

[54] REFRACTORY RUNNER

[75] Inventors: Harry R. Dudro, Jr., Pittsburgh, Pa.; Frank E. Morris, Portsmouth, Ohio

[73] Assignee: BMI, Inc., Pittsburgh, Pa.

[21] Appl. No.: 380,216

[22] Filed: May 20, 1982

[51] Int. Cl.³ ..... F27D 3/14
[52] U.S. Cl. ..... 266/196; 264/30; 266/231
[58] Field of Search ..... 266/196, 231; 264/30

[56] References Cited

U.S. PATENT DOCUMENTS 1,421,374 7/1922 Bagnell ..... 266/196
3,963,815 6/1976 Ezaki et al. ..... 264/30
4,262,885 4/1981 La Bate ..... 266/196

FOREIGN PATENT DOCUMENTS 2809196 9/1979 Fed. Rep. of Germany ..... 266/231
909458 10/1962 United Kingdom ..... 222/591

*Primary Examiner*—M. J. Andrews
*Attorney, Agent, or Firm*—Stanley J. Price, Jr.; John M. Adams

[57] ABSTRACT

Molten pig iron flows from the hearth of a blast furnace down a runner positioned on the floor of a cast house and into ladles for receiving the iron. The runner is constructed by a plurality of precast refractory side blocks and an interconnecting base of compacted particulate refractory material to form a substantially U-shaped trough extending a preselected distance and along a preselected path from the hearth to one or more ladles for conveying the iron from the blast furnace. The trough has opposed upstanding side walls and a floor extending between the bottom of the side walls. The side walls are formed by individual side blocks positioned in abutting end to end relation on the cast house floor. The compacted base forming the trough floor extends between and interconnects with the side blocks. The adjacent ends of the side blocks are notched to form a joint for receiving castable refractory material which upon setting interlocks the ends of adjacent side blocks. The side blocks are selectively positioned relative to one another to extend the path of the runner in a preselected direction and to connect branch runners with the main runner. In the event a portion of the side wall or floor of the trough becomes worn, a replacement side block is inserted and additional particulate refractory material compacted into position. The trough can be covered by positioning individual refractory cover blocks in end to end relation on the upper edges of the side blocks to span the trough above the floor.

11 Claims, 13 Drawing Figures

REFRACTORY RUNNER

BACKGROUND OF INVENTION

1. Field of the Invention

This invention relates to a refractory runner and a method of constructing a refractory runner and more particularly to a trough associated with a blast furnace for the conveyance of molten iron from the blast furnace into a trough formed by a plurality of refractory side blocks forming opposed side walls and a base or floor formed by compacting particulate refractory material between the opposed side walls.

2. Description of the Prior Art

In the manufacture of pig iron the molten iron flows through an iron notch in the hearth of a blast furnace into a main trough that is built on the floor of the cast house in the blast furnace plant. The molten iron flows down the trough or runner under a skimmer located near the end of the main trough. The skimmer separates any slag or cinder flowing with the iron and diverts the slag into the cinder ladles or to the cinder granulating pit. The molten iron continues to flow down the main trough. At selected intervals, branch troughs extend in various directions from the main trough. Gates or shutters located at the intersection of the main trough and the branch troughs divert the molten iron from the main trough into the respective branch troughs. The molten iron then flows through the branch troughs into iron ladles.

The main trough and branch troughs are emptied after each cast. After each cast, the runners must be carefully cleaned of both metal and slag. The side walls and floor of the trough are brushed with a thick clay or loam slurry, which when dry, protects the trough to prevent iron from sticking to the side walls and floor.

The trough has a generally U-shaped configuration formed by substantially upstanding side walls and a base or floor connected the lower ends of the side walls. It is known to construct a cast house trough or runner by firebrick forming the side walls and floors. However, the brick is subject to the deleterious effects of the molten iron and slag. After a period of time, the firebrick becomes damaged and must be replaced. Repair of a brick runner is a very time consuming task and removes the entire runner from operation during the period of repair.

Another form of cast house runner construction includes a steel plate trough base. The steel plate base is lined with firebrick and a carbon brick facing is placed next to the firebrick. This is known as a carbon-lined trough. The carbon brick is plastered with clay before cast time in order to prevent the carbon from oxidizing during the cast.

More recently, cast house runners have been fabricated of individual precast refractory trough sections. Each section has a substantially U-shaped configuration formed by a pair of oppositely positioned side walls connected at their lower end portions by a base or floor to form a unitary structure that includes integral side walls and floor. The U-shaped trough has a preselected length, width and height. The upper horizontal edges of the side walls are provided with lift points by which the trough section is secured to permit the section to be raised and lowered into and out of position relative to adjacent trough sections.

Damage and wear of a cast house runner generally occurs at the base or floor of the runner. For a runner constructed of refractory brick, the damaged brick must be removed and replacement brick inserted. For a runner constructed of a plurality of individual precast refractory trough sections, the particular section containing the damaged base must be removed. Consequently, if only a portion of the base of a trough section is damaged, the entire trough section must be removed and replaced even though a limited portion of the trough section is damaged. This requires maintaining a substantial inventory of trough sections. It is also necessary with this arrangement to construct a substantial number of trough sections having a preselected configuration to form the intersections of the main runner with the branch runners.

In addition whenever a trough section is removed and a replacement trough section inserted, the floor of the replacement section must be aligned with the floor of the adjacent sections. This is difficult in many instances where the floor of the undamaged adjacent trough sections has become warped after being exposed to many casts. Another obvious disadvantage of this type of runner construction is the downtime required to remove a damaged trough section and install and level the replacement trough section.

While it is known to provide replaceable runner sections in a cast house, the known runner constructions are not efficiently repaired. The known types of runner constructions require a large inventory of replacement components. The repair is time consuming and constitutes an interference in the operation of the blast furnace. Therefore, there is need for a runner construction that is easily assembled by components that are substantially uniform in construction thereby minimizing the number of component configurations required to be maintained in inventory and permitting repairs to be made without removing undamaged components.

SUMMARY OF THE INVENTION

In accordance with the present invention, there is provided a refractory runner construction that includes a first side block and a second side block. The first and second side blocks are fabricated of refractory material. The first and second side blocks are positioned in substantially upstanding, spaced apart relation. A base extends between and abuts the first and second side blocks. The base is formed of particulate refractory material compacted to a preselected thickness to form a continuous uninterrupted surface between the first and second side blocks. The first and second side blocks and the base define a trough having opposed upstanding side walls formed by the first and second side blocks joined by a floor formed by the base.

The length of the trough is extended by the positioning of a plurality of side blocks at each side wall in abutting end to end relationship. With this arrangement, a trough of a preselected length is constructed. Furthermore, the respective side blocks are angled relative to one another to change the course of direction of the channel of the trough. Accordingly, the base is formed between the side blocks by the insertion and compacting of the particulate material to form a base of the desired thickness. In the event of damage to the base, only the damaged portion need be repaired by the addition of particulate refractory material compacted into place.

Each side block is provided with vertically extending grooves or recesses at the opposite end portions. When adjacent side blocks are positioned in end to end relationship, the groove of one block abuts the groove of the adjacent block to form a connecting joint. Castable refractory material in a substantially fluid state is applied to the joint. Hardening of the castable material mechanically bonds the adjacent side blocks to one another.

In the event a side block becomes damaged and requires replacement, the connecting joint with the adjacent undamaged side blocks is broken and the damaged side block removed and a replacement side block inserted. Thereafter castable refractory material is added to the joints to secure the replacement side block in position.

Each of the side blocks is a monolithic structure having a substantially uniform rectangular cross section. The side blocks are precast in a range of lengths so as to facilitate flexibility in the construction of a total runner system including a main runner and branch runners extending from the main runner in a number of different directions.

Further in accordance with the present invention, there is provided a method of constructing a refractory runner that includes the steps of positioning a pair of refractory side blocks in substantially upstanding, spaced apart relation. Thereafter, a base of particulate refractory material is laid between the side blocks. The particulate refractory material is compacted to a preselected thickness to form a continuous uninterrupted surface between the pair of side blocks. A trough is thus formed having opposed upstanding side walls formed by the pair of side blocks joined by a floor formed by the particulate refractory material.

Accordingly, the principal object of the present invention is to provide a refractory runner construction that includes a pair of refractory side blocks positioned in substantially upstanding spaced apart relation to form opposed side walls which are joined by a base or floor of particulate refractory material compacted between the side walls to form a continuous uninterrupted surface therebetween.

Another object of the present invention is to provide a refractory runner construction and a method of making the same by the assembly of individual refractory components to form a U-shaped trough having opposed upstanding side walls formed by a plurality of refractory side blocks joined oppositely of one another by a floor of compacted particulate refractory material.

A further object of the present invention is to provide a refractory runner adapted for use in the manufacture of iron which flows from the hearth of a blast furnace down the runner and into ladles where the runner includes a main runner and branch runners extending from the main runner where each runner is formed by a plurality of side blocks positioned in end to end relation and mechanically bonded by a castable refractory mortar and includes a floor of compacted refractory material interconnected with the bottom of each side block.

An additional object of the present invention is to provide a refractory runner construction for use in conveying molten iron from a blast furnace where the runner is constructed by a method that facilitates flexibility in the design of a total runner system which is efficiently repaired.

These and other objects of the present invention will be more completely disclosed and described in the following specification, the accompanying drawings and the appended claims.

DESCRIPTION OF THE PREFERRED EMBODIMENTS

Figure 1:
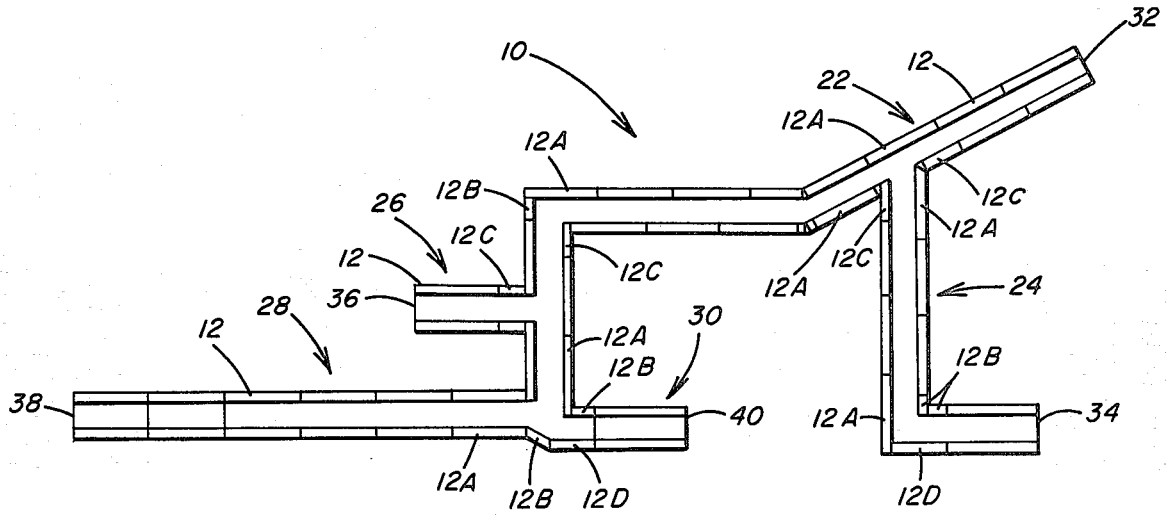
FIG. 1 is a schematic top plan view of a runner system adapted for use in the conveyance of molten iron from a blast furnace, illustrating a main runner and a plurality of branch runners for separating the molten iron from the slag.
Figure 2:
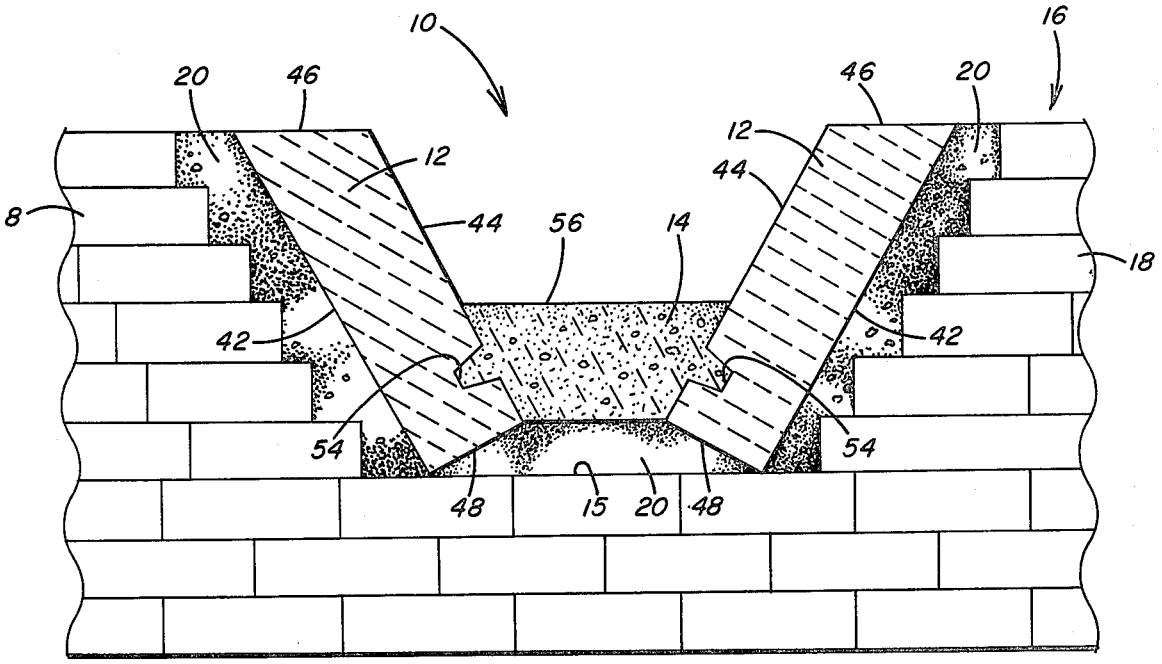
FIG. 2 is an enlarged fragmentary sectional view in side elevation of the runner positioned on the floor of the cast house, illustrating a pair of precast refractory side blocks forming the runner side walls which are joined by a refractory base of compacted particulate refractory material.

Referring to the drawings and particularly to FIGS. 1–5, there is illustrated a refractory runner generally designated by the numeral 10 formed by a plurality of individual side blocks 12 connected by a base 14, preferably composed of compacted particulate refractory material. An example application of the refractory runner 10 of the present invention is use in a cast house of a blast furnace plant where, as illustrated in FIG. 2, the runner 10 is positioned within a trench 15 formed in a floor 16 of the cast house. Conventionally, the floor 16 is formed by layers of firebrick 18, and the substantially V- or U-shaped trench 15 is cut out to receive the runner 10. A castable fill 20 is positioned between the individual blocks 12, base member 14 and the firebrick 18 to maintain the runner 10 at a preselected elevation and slope within the trench 15.

In a cast house, the runner system 10, as illustrated in FIG. 1, includes a main runner generally designated by the numeral 22 intersecting a plurality of branch runners 24, 26, 28 and 30. The main runner 22 has an inlet 32 and the branch runners 24–30 have outlets 34–40 respectively. The main runner inlet 22 extends from the hearth of the blast furnace (not shown) and the outlets 34–40 of the respective branch runners 24–30 communicate with ladles. The molten pig iron flows out of the blast furnace through the inlet 32 into the main runner 22. Slag or cinder also formed during the iron manufacturing process follows the molten iron into the main runner 22.

The slag following the iron is stopped in a well known manner by a skimmer (not shown) located at the intersection of the main runner 22 and the branch runner 24. The molten iron is heavier than the slag or cinder and, therefore, passes beneath the skimmer. The slag, however, is stopped by the skimmer so that it is separated from flowing with the iron. The skimmer diverts the slag from the main runner 22, for example, into the branch runner 24. The slag then runs off through the branch runner 24 to the outlet 34 and therefrom into a slag ladle or a granulating pit.

The iron continues to flow down the main runner 22 and is diverted by gates (not shown) positioned at the intersections of the main runner 22 with the branch runners 26, 28 and 30. The operation of the gates is selective so that at intervals along the main runner 22 the iron is diverted to the outlets 36, 38 and 40 into iron ladles (not shown).

With the present invention, each of the runners 22–30 is fabricated of the individual refractory side blocks 12 interconnected with the compacted particulate refractory base 14. Each of the refractory side blocks 12 has the same basic configuration of the example side block 12 illustrated in FIGS. 3–5. However, in order to facilitate the construction of runners to extend at relative angles and having selected lengths, the side blocks 12 are provided in a range of length dimensions where the height and thickness of each side block 12 preferably does not differ.

The side blocks are precast from refractory material in a variety of incremental lengths. For example, as illustrated in FIG. 1, at the intersection of main runner 22 with the branch runner 24, side blocks 12A, 12B and 12C are utilized to obtain the desired angular relation between main runner 22 and branch runner 24. Also, as noted, the branch runner 24 has an L-shaped configuration which is constructed by utilizing side blocks 12A, 12B and 12D, each having a different length. Preferably the side blocks 12 are precast in incremental lengths from 12 inches to 48 inches where the standard length, for example, of side block 12A is 48 inches and side blocks 12B, 12C and 12D are 12, 24 and 36 inches respectively.

The present invention thus obviates the need for the manufacture of custom runners for the intersection points as encountered with the prior art runner system where individual runner sections must be precast in a desired configuration depending upon the angle at which a branch runner extends from the main runner. With the present invention, substantially greater flexibility is permitted in the construction of the runner intersection because the side blocks 12 have a common configuration and are available in incremental lengths. This feature also permits efficient repair of a runner by replacing only the damaged side block 12 or a portion of the base 14 without having to remove entire runner sections which is required with the prior art where each runner section is an integral unit formed by precasting the side walls and floor. With the prior art construction, an entire runner section must be removed to repair a side wall even though the othe side wall and base remain undamaged. However, with the present invention of constructing a runner by individual components, only a damaged component need be replaced with the undamaged components remaining in position.

Figure 5:
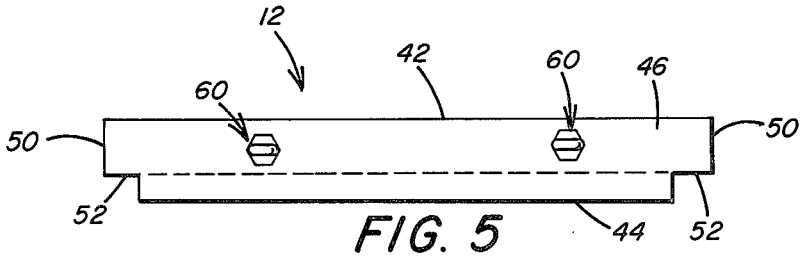
FIG. 5 is a top plan view of the side block shown in FIG. 3, illustrating notches at the ends of the side block for forming a joint with adjacent side blocks to receive castable refractory material to interconnect adjacent side blocks.
Figure 3:
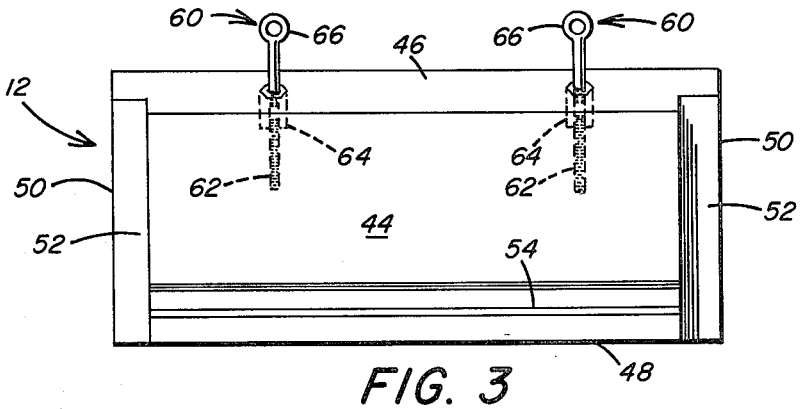
FIG. 3 is a front view of an individual side block used in the construction of the runner, shown in FIGS. 1 and 2, precast a preselected length and including attachments for raising and lowering the side block into position.
Figure 4:
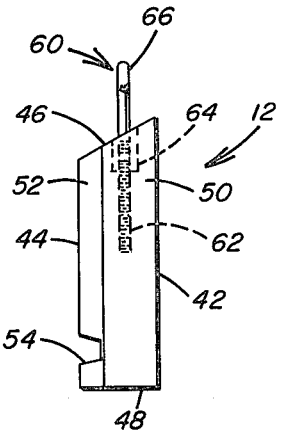
FIG. 4 is a view in side elevation of the side block shown in FIG. 3, illustrating a longitudinally extending keyway adjacent the bottom of the side block for receiving the particulate refractory material forming the base of the runner.

Referring to FIGS. 3–5 there is illustrated in greater detail a side block 12 representative of the side blocks 12A, 12B, 12C, and 12D used in the construction of the runners 22–30 illustrated in FIG. 1. The side block 12 is precast of refractory material having a composition adapted for use in the construction of a runner which conveys molten pig iron from a blast furnace. The side block 12 is a monolithic structure having a preselected height, length, and thickness. The side block 12 is defined by an outer surface 42, an inner surface 44, an upper edge 46, a lower edge 48, and opposite end portions 50. As illustrated in FIG. 5, the inner surface 44 is provided with vertically extending notches or grooves 52 adjacent the end portions 50. As illustrated in FIG. 4, the upper edge 46 is angled and the lower edge 48 is substantially horizontal but the edges 46 and 48 may both be angled or horizontal as desired.

In the assembly of the refractory runner 10, the side blocks 12 are preferably positioned in end to end relation in the trench 15 of the cast house floor 16 to form each of the opposed trough side walls as illustrated in FIG. 2. The side blocks 12 are positioned at a preselected angle from the vertical so that the inner surfaces 44 slope downwardly to form the sloped side walls of the trough. With this arrangement only a portion of the lower edge 48 is positioned on the firebrick 18, and the upper edges 46 are positioned in a horizontal plane. A suitable castable fill material 20 supports the outer surfaces 42 on the adjacent layers of firebrick 18 with additional fill 20 added beneath the lower edges 48 and extending along the trench to receive the particulate refractory base 14. The angle at which the side blocks 12 are positioned within the trench 15 of the cast house floor 16 is selective and can be varied by the amount of fill 20 positioned between the layers of firebrick 18 and the side blocks 12.

As illustrated in FIGS. 3 and 4, each side block 12 preferably includes on the inner surface 44 a longitudinally extending keyway 54 positioned closely adjacent the lower edge 48. The keyway 54 shown in FIG. 2 is adapted to receive the particulate refractory material that forms the runner base 14. Once the side blocks 12 are positioned at the desired angle within the trench 15 of the cast house floor 16 the particulate refractory material is added to the trench so as to engage and occupy the keyways 54 and form the solid base 14 between the side walls formed by the side blocks. In this manner a dovetail connection is formed to connect the base 14 with an opposed pair of side blocks 12 as illustrated in FIG. 2. The base 14 is firmly compacted to the desired thickness and becomes interlocked with the opposed side blocks 12.

Preferably the refractory particulate material forming the base 14 is compacted to provide a continuous uninterrupted horizontal trough floor 56 extending between the trough side walls formed by the side blocks 12. It also will be apparent that other configurations can be utilized to interlock the base 14 with the side blocks 12, as for example, by providing each block 12 with an outwardly extending key or flange. The key would then be embedded in the particulate material of the base to securely interlock the base 14 with the side blocks 12.

Figure 6:
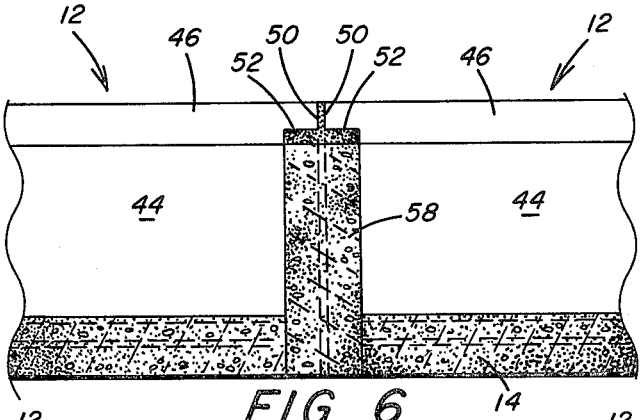
FIG. 6 is a schematic fragmentary view in side elevation of the interconnection of adjacent side blocks and the connection of the base to the side blocks.
Figure 7:
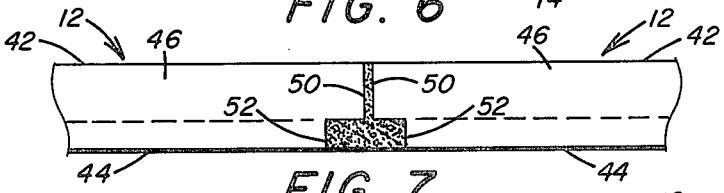
FIG. 7 is a top plan view of the connected side blocks shown in FIG. 6, illustrating castable refractory material positioned in the joint between adjacent side blocks.

The joint for connecting adjacent side blocks 12 in end to end relation is illustrated in FIGS. 6 and 7. To form a straight-away section of a runner, side blocks 12 are adjacently positioned in end to end relation. The adjacent end portions 50, as illustrated in FIGS. 6 and 7, are slightly spaced apart to receive a castable joint material 58 in the notches 52.

Preferably the joint material 58 is a castable refractory material similar to the refractory material utilized for the base 14. However, the joint material 58 is substantially fluid upon application to fill the notches 52 and between the side blocks 12. After a period of time the joint material 58 sets to mechanically bond together the adjacent side blocks 12.

As illustrated in FIG. 7, the inner surfaces 44 of the adjacent side blocks 12, together with the joint material 58, form a continuous surface for the trough side wall in which the surfaces 44 remain in the same plane. However, to construct the intersection of the respective branch runners with the main runner, it is necessary to angle the side blocks 12 relative to one another. With the present invention, the provision of the notches 52 facilitates relative positioning of the blocks 12 at a preselected angle to form an angle in the side wall of the trough. This occurs, for example, at the intersection of the main runner 22 with the branch runners 24, 26, 28, and 30.

Figure 8:
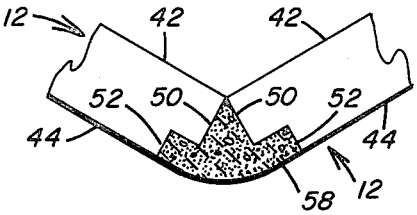
FIGS. 8, 9 and 10 are fragmentary schematic illustrations of example joints for connecting adjacent side blocks at a preselected angle to facilitate a change in the course of direction of the runner.
Figure 9:
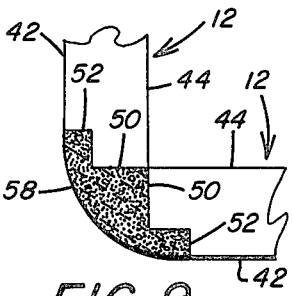
Figure 10:
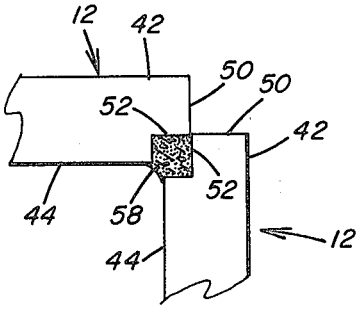

As seen in FIGS. 8–10, adjacent side blocks 12 can be connected in a number of angular positions. Once the desired relative angular position is established, the castable refractory material 58 is applied to the exposed adjacent notches 52. The joint material 58 is allowed to harden to secure the side blocks 12 together in the desired angular relationship. With this arrangement the entire runner system is constructed using the same components, i.e. the side blocks 12, for both the straight-away runner sections and the angular runner sections. The only variable being the length of the side blocks 12 utilized to construct an intersection of a preselected configuration.

The individual side blocks 12 are readily moved into and out of position in the trench 15 of the cast house floor 16 by lifting devices generally designated by the numeral 60 in FIGS. 3–5. Preferably the lifting devices 60 are formed integral with the side blocks 12 during their initial precasting. A variety of lifting devices 60 may be utilized, and the devices 60 illustrated in FIGS. 3–5 are only one example. The illustrated lifting devices 60 include a plurality of releasably interconnected components.

A first externally threaded rod 62 is embedded within the body of the side block 12 beneath the upper surface 46. Any number of lifting devices 60 may be utilized, and accordingly the threaded rods 62 may be selectively spaced along the length of the side block 12. In FIGS. 3–5, a pair of rods 62 are positioned adjacent the respective end portions 50. Also embedded within the body of the side blocks 12 is an internally threaded coupling 64 which receives the upper end of the externally threaded rod 62. The coupling 64 extends to the upper surface 46 so as to expose the internally threaded bore of the coupling 64. An eye bolt 66 having an externally threaded end portion is threaded into the coupling 64. The aperture of the eye bolt 66 is adapted to receive any type of hoisting device to permit maneuvering of the side block 12 into and out of position.

Thus with this arrangement, in the event a side block 12 becomes damaged under the influence of the deleterious effects of the molten iron running through the trough after an extended period of use, the lifting devices 60 facilitate the removal of the damaged side block 12 and the insertion of a replacement side block. Prior to the removal of a damaged side block 12, the joint material 58 connecting the damaged side block 12 with its adjacent side blocks is removed so that the damaged side block 12 is free to be removed.

Further in accordance with the present invention, the formation of the base 14 by particulate refractory material permits efficient repair of the base which is subject to the most severe wear due to contact with the molten iron. As a rule damage to the base 14 is localized; not requiring replacement of the base 14. Therefore only portions of the base 14 are periodically repaired. To repair a damaged portion of the base 14, the damaged refractory material is removed, for example, by cutting out the damaged portion with pneumatic jackhammers or the like. Thereafter, replacement refractory material is added and compacted to the elevation of the surrounding undamaged portions of the base 14. This method permits ease of repair of the base 14 without the need for laying blocks for other rigid structures which are difficult to level with adjacent structures.

Figure 11:
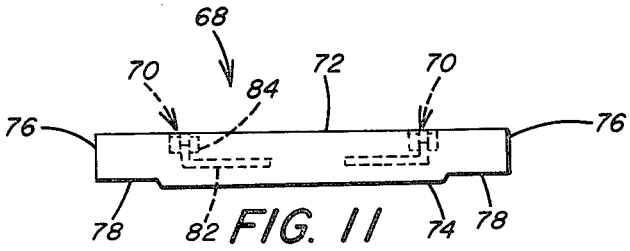
FIG. 11 is an end view of an individual cover block for positioning on the upper surfaces of opposed side blocks to cover a portion of the trough, illustrating in phantom the lifting points for the cover plate.
Figure 12:
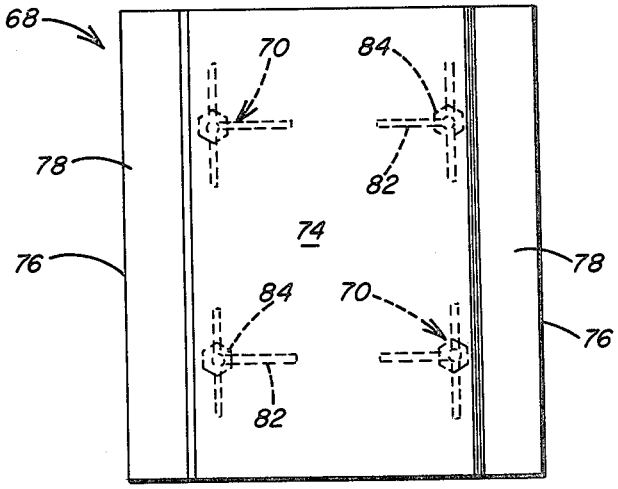
FIG. 12 is a bottom view of the individual cover block shown in FIG. 11, illustrating the lifting points of spaced longitudinally extending grooves for securing the cover block to the side blocks.
Figure 13:
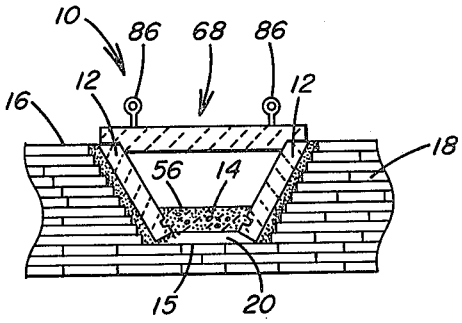
FIG. 13 is a schematic illustration of a cover block in position on the runner.

Now referring to FIGS. 11–13, there is illustrated means for covering the runner system 20 by a plurality of cover blocks 68, one of which is illustrated in FIGS. 11–13. The cover blocks 68 are adapted for positioning on the upper edges 46 of the side blocks 12 to span the trough above the floor and thereby enclose the trough. This is particularly desirable to reduce the pollutants emitted to the atmosphere surrounding the trough and contain the pollutants in the trough. Each cover block 68 is also precasted of a refractory material. The cover block 68 is provided with a plurality of lifting devices 70 by which the cover block is lowered and raised into and out of position on the side blocks 12.

The cover block 68 is also a monolithic structure having a preselected length and a width corresponding to the width of the trough at the upper edges 46 of the trough side walls. Each cover block 68 is defined as illustrated in FIG. 11 by an upper surface 72, a lower surface 74, and side edges 76 with a recess 78 formed in the lower surface 74 adjacent each side edge 76. The recesses 78 are adapted to engage the upper surfaces 46 of the side blocks 12 to securely position the cover block in place on the trough side walls.

The lifting devices 70 are similar to the lifting devices 60 described above for the side blocks 12. As for example, each lifting device 70 includes an externally threaded rod 82 suitably anchored within the body of the cover block 68. A coupling 84 is threaded onto the rod 82 and is positioned immediately below the upper surface 72. As illustrated in FIG. 13, an eye bolt 86 is threaded into each coupling 84. Further as illustrated in FIG. 13, the cover block 68 is supported a sufficient distance above the trough floor 56 to permit unobstructed flow of the iron in the trough. A runner can be completely covered by positioning the cover blocks 68 in abutting end to end relationship the entire length of the runner or the runner can be covered at intervals.

According to the provisions of the Patent Statutes, we have explained the principle, preferred construction, and mode of operation of our invention and have illustrated and described what we now consider to represent its best embodiments. However, it should be understood that, within the scope of the appended claims the invention may be practiced otherwise than as specifically illustrated and described.

We claim:

1. A refractory runner construction comprising,
a first side block and a second side block,
said first and second side blocks being fabricated of refractory material,
said first and second side blocks being positioned in substantially upstanding, spaced apart relation,
said first and second side blocks each having a lower edge portion,
a base extending between and abutting said lower edge portions of said first and second side blocks, said base being formed by a layer of particulate refractory material compacted to a preselected thickness to form a continuous, uninterrupted surface between said first and second side blocks,
means positioned at said lower edge portions of said first and second side blocks for receiving said particulate refractory material so that when said particulate refractory is compacted said first and second side blocks are interlocked, and
said first and second side blocks being interlocked by said base defining a trough having opposed upstanding side walls formed by said first and second side blocks joined by a floor formed by said base.

2. A refractory runner as set forth in claim 1 which includes,
means for supporting said first and second side blocks in a preselected position spaced oppositely of one another to slope said trough side walls at a preselected angle, and
said supporting means being adapted to receive said base between said first and second side blocks to form said trough having a substantially U-shaped configuration.

3. A refractory runner as set forth in claim 1 in which,
said base is replaceable when worn with said first and second side blocks being maintained in position.

4. A refractory runner as set forth in claim 1 in which said means for receiving said particulate material includes,
said first and second side blocks each having a keyway at said lower edge portions, and
said particulate refractory material being compacted into said keyway to engage said first and second side blocks with said base so that said floor extends continuously between said side walls.

5. A refractory runner as set forth in claim 1 in which,
said first and second side blocks are precast of a refractory material to form a monolithic structure having a preselected length, width and height.

6. A refractory runner as set forth in claim 1 which includes,
lifting means formed integral with said first and second side blocks for moving said respective side blocks into and out of position.

7. A refractory runner as set forth in claim 6 in which said lifting means includes,
an externally threaded rod embedded in each of said side blocks,
a coupling engaging said threaded rod within said respective side blocks,
said coupling having an internally threaded bore for receiving at one end said threaded rod, and
a fastener received at the opposite end within said coupling internally threaded bore and extending upwardly from said respective side blocks.

8. A refractory runner as set forth in claim 1 which includes,
a cover block supported by said first and second side blocks,
said cover block extending between said first and second side blocks and including means for securing said cover block in position on said side blocks, and
means for lifting said cover block into and out of position on said side blocks to cover said trough above said floor.

9. A refractory runner as set forth in claim 1 which includes,
a plurality of additional side blocks positioned adjacent one another in end to end relation with said first and second side blocks to extend said side walls of said trough a preselected length, and
a base extension formed of additional particulate refractory material compacted into engagement with and extending between said additional side blocks to extend said floor of said trough a preselected length.

10. A refractory runner as set forth in claim 9 which includes,
formable refractory material positioned between and in contact with said adjacent said blocks to securely connect said adjacent side blocks in end to end relation.

11. A refractory runner as set forth in claim 10 in which,
said adjacent side blocks are positioned at a preselected angle relative to one another to extend said trough in a preselected course of direction.

* * * * *